US009631879B2

(12) United States Patent
Parson

(10) Patent No.: US 9,631,879 B2
(45) Date of Patent: Apr. 25, 2017

(54) ALUMINUM ALLOY FOR EXTRUSION AND DRAWING PROCESSES

(71) Applicant: Rio Tinto Alcan International Ltd., Montreal, Quebec (CA)

(72) Inventor: Nicholas Charles Parson, Kingston (CA)

(73) Assignee: Rio Tinto Alcan International Limited, Montreal (CA)

( * ) Notice: Subject to any disclaimer, the term of this patent is extended or adjusted under 35 U.S.C. 154(b) by 72 days.

(21) Appl. No.: 13/946,049

(22) Filed: Jul. 19, 2013

(65) Prior Publication Data

US 2014/0048239 A1 Feb. 20, 2014

Related U.S. Application Data

(63) Continuation of application No. 12/183,575, filed on Jul. 31, 2008, now abandoned, which is a (Continued)

(30) Foreign Application Priority Data

Apr. 24, 2008 (CA) ..... 2629816

(51) Int. Cl.
*C22C 21/00* (2006.01)
*F28F 21/08* (2006.01)
(Continued)

(52) U.S. Cl.
CPC ..... *F28F 21/084* (2013.01); *C22C 21/16* (2013.01); *C22F 1/057* (2013.01)

(58) Field of Classification Search
CPC ..... F28F 21/084; C22C 21/00
(Continued)

(56) References Cited

U.S. PATENT DOCUMENTS 4,357,397 A 11/1982 Baba et al.
4,560,625 A 12/1985 Kaifu et al.
(Continued)

FOREIGN PATENT DOCUMENTS

CA 2409870 11/2001
EP 0 241 125 10/1987
(Continued)

OTHER PUBLICATIONS

N.D.A. Kooij et al, "New High Strength Alloys for Brazing with Long Life Corrosion Properties" VTMS Conf. Proc., Indianapolis, In 971882, 1997; pp. 763-764.
(Continued)

*Primary Examiner* — Roy King
*Assistant Examiner* — Janelle Morillo
(74) *Attorney, Agent, or Firm* — Banner & Witcoff, Ltd.

(57) ABSTRACT

An extrudable aluminum alloy composition includes, in weight percent, between 0.60 and 0.90 manganese, between 0.45 and 0.75 copper, between 0.05 and 0.24 magnesium, less than 0.30 iron, less than 0.30 silicon, less than 0.05 titanium, less than 0.05 vanadium, and a Cu/Mg ratio higher or equal to 3. It also relates to aluminum alloy heat exchanger extruded or drawn tube and extruded or drawn aluminum alloy tubing having the above-described aluminum alloy composition. It also relates to a heat exchanger comprising a plurality of extruded or drawn tube sections having the above-described aluminum alloy composition and a process for manufacturing same.

17 Claims, 5 Drawing Sheets

Related U.S. Application Data continuation-in-part of application No. 12/109,245, filed on Apr. 24, 2008, now abandoned.

(51) Int. Cl.
*C22C 21/16* (2006.01)
*C22F 1/057* (2006.01)

(58) Field of Classification Search
USPC ..... 148/439; 420/533, 553
See application file for complete search history.

(56) References Cited

U.S. PATENT DOCUMENTS

| | | | |
|---|---|---|---|
| 4,586,964 | A | 5/1986 | Finnegan et al. |
| 4,636,356 | A | 1/1987 | Iwasaki et al. |
| 4,649,087 | A | 3/1987 | Scott et al. |
| 4,673,551 | A | 6/1987 | Sugiyama et al. |
| 4,727,001 | A | 2/1988 | Takemoto et al. |
| 4,761,267 | A | 8/1988 | Takeno et al. |
| 5,011,547 | A | 4/1991 | Fujimoto et al. |
| 5,037,707 | A | 8/1991 | Fortin et al. |
| 5,041,343 | A | 8/1991 | Fortin et al. |
| 5,176,205 | A | 1/1993 | Anthony |
| 5,217,547 | A | 6/1993 | Ishikawa et al. |
| 5,292,595 | A | 3/1994 | Yamauchi et al. |
| 5,356,725 | A | 10/1994 | Eichhorn et al. |
| 5,857,266 | A | 1/1999 | Raybould et al. |
| 5,863,669 | A | 1/1999 | Miller |
| 5,961,752 | A | 10/1999 | Bergsma |
| 6,294,272 | B2 | 9/2001 | Sontgerath et al. |
| 6,408,938 | B2 | 6/2002 | Gray et al. |
| 6,413,331 | B1 | 7/2002 | Hurd et al. |
| 6,503,446 | B1 | 1/2003 | Ren et al. |
| 6,623,693 | B1 | 9/2003 | Sircar |
| 6,756,133 | B2 | 6/2004 | Palmer et al. |
| 6,923,876 | B2 | 8/2005 | Kucza et al. |
| 2002/0007881 | A1* | 1/2002 | Daaland et al. ..... 148/440 |
| 2002/0037426 | A1 | 3/2002 | Yamada et al. |
| 2005/0064226 | A1 | 3/2005 | Benedictus et al. |
| 2006/0014043 | A1 | 1/2006 | Haller et al. |
| 2006/0105193 | A1 | 5/2006 | Burger et al. |
| 2007/0166565 | A1 | 7/2007 | Fukumoto et al. |

FOREIGN PATENT DOCUMENTS

| | | |
|---|---|---|
| EP | 0 290 358 | 1/1992 |
| EP | 0 823 305 | 10/1998 |
| EP | 1 038 984 | 9/2000 |
| EP | 0 799 667 | 2/2001 |
| EP | 0 718 072 | 7/2003 |
| JP | 02-030394 | 1/1990 |
| JP | 06-057361 | 3/1994 |
| JP | 09-176767 | 7/1997 |
| WO | 82/01014 | 4/1982 |
| WO | 94/22633 | 10/1994 |
| WO | 02/49798 | 6/2002 |
| WO | 02/070189 | 9/2002 |

OTHER PUBLICATIONS

N.D.A. Kooij et al, "The Development of Two High Strength Aluminium Brazing Sheet Alloys With Long Life Corrosion Properties", Alumintech Conf. Proc., Atlanta, GA, 1997, pp. 188-193.

H. Scott Goodrich et al. "Aging Response and Elevated Temperature Strengthening in Brazing Sheet Core Alloys of 3xxx Series Aluminum", SAE Internation; VTMS Conf. Nashville TN; May 2001.

H. Scott Goodrich et al, "Age Hardening Effects in 3xxx Series Brazing Sheet Core Alloys" VTMS 4 Conf. Proc. IMechE , London; 1999; p. 483.

Canadian Patent Application 2,638,403, Requisition by the Examiner, dated Mar. 10, 2015.

* cited by examiner

ALUMINUM ALLOY FOR EXTRUSION AND DRAWING PROCESSES

CROSS-REFERENCE TO RELATED APPLICATIONS

This application is a continuation of U.S. patent application Ser. No. 12/183,575 filed Jul. 31, 2008, which is a continuation-in-part of U.S. patent application Ser. No. 12/109,245 filed Apr. 4, 2008, now abandoned, the specifications of which are hereby incorporated by reference in their entirety. This application claims priority of Canadian patent application 2,629,816 filed Apr. 4, 2008, the specification of which is hereby incorporated by reference in its entirety.

FIELD OF THE INVENTION

The invention relates to an aluminum alloy having good elevated temperature properties and, more particularly, to an aluminum alloy extrudable or drawable into relatively thin wall tubing.

DESCRIPTION OF THE PRIOR ART

Aluminum alloy extrusions are widely used in heat transfer applications including air conditioning, refrigeration and automotive applications. Charge air coolers for heavy duty diesel engines have typically used extruded tubing in AA 3003 alloy (in weight %, max. 0.60 Si, max. 0.70 Fe, 0.05-0.20 Cu, 1.0-1.5 Mn, max. 0.10 Zn, other elements max. 0.05 each and max 0.15 in total, the remainder being Al) which has performed satisfactorily in this application in terms of ease of making the tube and in-service properties.

However, with changes to environmental legislation, the operating temperatures of charge air coolers are increasing and recirculation of a proportion of the engine exhaust gases is becoming necessary. AA 3003 alloy cannot meet these new service requirements and a new aluminum alloy is required with the combination of improved strength over AA 3003, the ability to be furnace brazed and resistance to exhaust gas corrosion.

At the same time, it has to be possible to extrude the alloy into thin wall tubing at commercially acceptable production rates. Often alloy additions made to aluminum to improve strength can be detrimental to the ability to extrude fast, often termed extrudability. The main factors controlling this are the alloy flow stress at extrusion temperature and the alloy melting point or solidus.

Many aluminum alloys are processed into brazing sheet which can be fabricated into tubing by folding and resistance welding. This production route via hot and cold rolling, does not have the same limitations as the extrusion route and a wider range of alloy compositions can be successfully produced in sheet form.

The attraction of an extruded product is that the tube wall thickness can be varied around the periphery which is not possible with a sheet product. The challenge is therefore to develop an alloy composition which gives the maximum strength increase for the minimum loss of extrudability while at the same time having adequate acidic corrosion resistance.

BRIEF SUMMARY OF THE INVENTION

It is therefore an aim of the present invention to address the above mentioned issues.

According to a general aspect, there is provided an extrudable aluminum alloy composition comprising, in weight percent, between 0.60 and 0.90 manganese, between 0.45 and 0.75 copper, between 0.05 and 0.24 magnesium, less than 0.30 iron, less than 0.30 silicon, less than 0.05 titanium, less than 0.05 vanadium, and a Cu/Mg ratio higher or equal to 3.

According to another general aspect, there is provided an extrudable aluminum alloy composition consisting essentially of, in weight percent, between 0.60 and 0.90 manganese, between 0.45 and 0.75 copper, between 0.05 and 0.24 magnesium, less than 0.30 iron, less than 0.30 silicon, less than 0.05 titanium, less than 0.05 vanadium, and a Cu/Mg ratio higher or equal to 3.

According to another general aspect, there is provided an extruded or drawn tube for an aluminum alloy heat exchanger comprising an aluminum alloy composition having, in weight percent, between 0.60 and 0.90 manganese, between 0.45 and 0.75 copper, between 0.05 and 0.24 magnesium, less than 0.30 iron, less than 0.30 silicon, less than 0.05 titanium, less than 0.05 vanadium, and a Cu/Mg ratio higher or equal to 3.

According to still another general aspect, there is provided an extruded or drawn aluminum alloy tubing comprising an aluminum alloy composition having, in weight percent, between 0.60 and 0.90 manganese, between 0.45 and 0.75 copper, between 0.05 and 0.24 magnesium, less than 0.30 iron, less than 0.30 silicon, less than 0.05 titanium, less than 0.05 vanadium, and a Cu/Mg ratio higher or equal to 3.

According to a further general aspect, there is provided a process to manufacture a heat exchanger, comprising: extruding at least one tubing having an aluminum alloy composition having, in weight percent, between 0.60 and 0.90 manganese, between 0.45 and 0.75 copper, between 0.05 and 0.24 magnesium, less than 0.30 iron, less than 0.30 silicon, less than 0.05 titanium, less than 0.05 vanadium, and a Cu/Mg ratio higher or equal to 3; and brazing at least one extruded tubing section to at least one heat exchanger component.

According to a further general aspect, there is provided a heat exchanger comprising a plurality of extruded or drawn tube sections having an aluminum alloy composition having, in weight percent, between 0.60 and 0.90 manganese, between 0.45 and 0.75 copper, between 0.05 and 0.24 magnesium, less than 0.30 iron, less than 0.30 silicon, less than 0.05 titanium, less than 0.05 vanadium, and a Cu/Mg ratio higher or equal to 3.

According to a further general aspect, there is provided an extrudable aluminum alloy ingot comprising an aluminum alloy composition including, in weight percent, between 0.60 and 0.90 manganese, between 0.45 and 0.75 copper, between 0.05 and 0.24 magnesium, less than 0.30 iron, less than 0.30 silicon, less than 0.05 titanium, less than 0.05 vanadium, and a Cu/Mg ratio higher or equal to 3, the aluminum alloy ingot being homogenized and having a conductivity ranging between 35 and 38% IACS following homogenization.

According to still another general aspect, there is provided extruded or drawn tubes for an aluminum alloy heat exchanger comprising an aluminum alloy composition having, in weight percent, between 0.60 and 0.90 manganese, between 0.45 and 0.75 copper, between 0.05 and 0.24 magnesium, less than 0.30 iron, less than 0.30 silicon, less than 0.05 titanium, less than 0.05 vanadium, and a Cu/Mg ratio higher or equal to 3, wherein the tubes are extruded or drawn from a homogenized billet having a conductivity ranging between 35 and 38% IACS following homogenization.

According to another general aspect, there is provided a process to manufacture a heat exchanger, comprising: homogenizing a billet having an aluminum alloy composition including, in weight percent, between 0.60 and 0.90 manganese, between 0.45 and 0.75 copper, between 0.05 and 0.24 magnesium, less than 0.30 iron, less than 0.30 silicon, less than 0.05 titanium, less than 0.05 vanadium, and a Cu/Mg ratio higher or equal to 3, the homogenized billet having a conductivity ranging between 35 and 38% IACS; extruding at least one tubing section from the homogenized billet; and brazing the at least one extruded tubing section to at least one heat exchanger component.

BRIEF DESCRIPTION OF THE DRAWINGS

It will be noted that throughout the appended drawings, like features are identified by like reference numerals.

DETAILED DESCRIPTION

Figure 1:
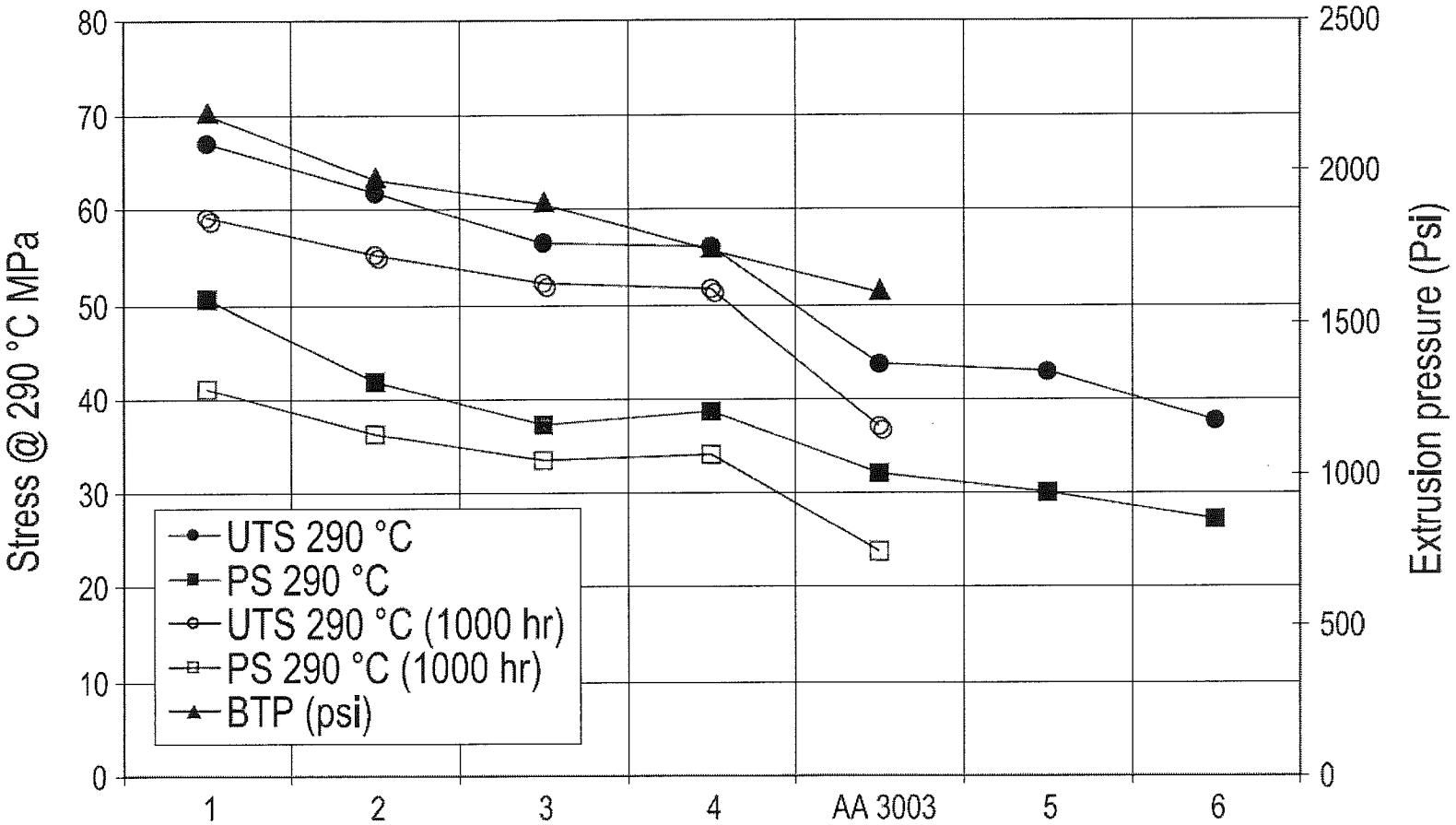
FIG. 1 is a graph showing the tensile properties and extrusion breakthrough pressure for the seven (7) aluminum alloys presented in Table 1.

The aluminum alloy contains, aside from aluminum and inevitable impurities, the following amounts of alloying elements. In an embodiment, it contains between 0.60 and 0.90 wt % of manganese (Mn), between 0.45 and 0.75 wt % of copper (Cu), between 0.05 and 0.24 wt % of magnesium (Mg), less than 0.30 wt % of iron (Fe), less than 0.30 wt % of silicon (Si), less than 0.05 wt % of titanium (Ti), less than 0.05 wt % of vanadium (V), and a Cu/Mg ratio higher or equal to 3, i.e. the ratio between the copper content and the magnesium content in weight percent. In an embodiment, the Cu/Mg ratio is lower than 15.

The aluminum alloy has adequate corrosion resistance, elevated temperature strength and extrudability (or drawing properties). It can thus be used for any extruded or drawing applications requiring at least one of these properties. In an embodiment, the aluminum alloy provides a strength improvement of at least 10% over aluminum alloy AA 3003. For example and without being limitative, the aluminum allow has a tensile strength (UTS) and a proof strength (PS), tested according to ASTM E21 at 290° C. for instantaneous testing, higher or equal to 48 and 35 MPa respectively.

The cast billet or ingot can be homogenized at a temperature above 570° C. and below the aluminum alloy melting point for up to 8 hours. Then, the alloy can be cooled at a cooling rate below 200° C. per hour to decrease the alloy flow stress, making it more extrudable or drawable. The parameters of the homogenization cycle are selected to obtain a conductivity of 35 to 38% IACS (International Annealed Copper Standard), which is higher than the conductivity of the cast aluminum alloy material. In an embodiment, the aluminum alloy conductivity remains substantially unchanged in the following extrusion and brazing cycles, if any.

For example, it can be used as a billet for the production of tubing either by extrusion or drawing. For example and without being limitative, the end product can be thin wall <1.5 mm extruded or drawn tubes assembled into a brazed heat exchanger. The brazing step can be, for instance, a vacuum brazing or controlled atmosphere brazing (CAB) wherein at least one tubing section is brazed to heat exchanger components such as manifold, internal and external corrugated fins, etc. These heat exchangers can be used in charge air coolers, for instance.

It can also be used in non brazed applications and any other applications where adequate properties at relatively high temperature are desirable.

Manganese additions are beneficial for strengthening; however, at relatively high content, manganese is also detrimental to extrudability. Moreover, its strengthening efficiency is relatively poor and does not provide improvement for corrosion resistance. In an embodiment, the manganese content of the aluminum alloy ranges between 0.60 and 0.90 wt %, in another embodiment, it ranges between 0.65 and 0.85 wt %, and, in still another embodiment, it ranges between 0.70 and 0.80 wt %.

A low magnesium content, such as below 0.25 wt %, is beneficial to extrudability and strength efficiency. Moreover, a deliberate addition is necessary for acceptable corrosion resistance. Thus, in an embodiment, the magnesium content of the aluminum alloy ranges between 0.05 and 0.24 wt %, in another embodiment, it ranges between 0.05 and 0.20 wt % and, in still another embodiment, it ranges between 0.05 and 0.12 wt %.

Strength and extrusion pressure increase with copper content but the strength/extrudability efficiency remains relatively stable. A minimal copper content is necessary for good corrosion resistance; however, if the copper content is too high, the alloy solidus becomes too low for successful furnace brazing. Moreover, the combination of copper and magnesium additions can give a good combination of strength and strength/extrudability efficiency. Thus, in an embodiment, the copper content of the aluminum alloy ranges between 0.45 and 0.75 wt %, in another embodiment, it ranges between 0.50 and 0.60 wt %, and, in still another embodiment, it ranges between 0.57 and 0.63 wt %.

A low magnesium content combined with a higher copper content is desirable since it is advantageous to both strength and extrudability. Moreover, it promotes resistance to corrosion. This combination of copper and magnesium can be represented by the copper and magnesium ratio. A Cu/Mg ratio above or equal to 3.0 is also beneficial. In an embodiment, the Cu/Mg ratio is below 15.

High iron levels are detrimental to corrosion resistance while low iron levels are known to be beneficial for the quality of the extruded surface finish. In an embodiment, the iron content of the aluminum alloy is below 0.30 wt %, in another embodiment, it is below 0.25 wt % and, in still another embodiment, it ranges between 0.15 and 0.25 wt %.

In an embodiment, the silicon content is maintained below 0.30 wt % to make the material compatible with sacrificial brown band formation due to silicon diffusion from the filler metal during brazing. In an embodiment, the silicon content of the aluminum alloy is below 0.30 wt %, in another embodiment, it is below 0.20 wt % and, in still another embodiment, it ranges between 0.05 and 0.15 wt %.

The addition of nickel has no benefits on high temperature strength and can lead to relatively significant corrosion attack. In an embodiment, it should be kept below 0.05 wt %.

Additions of titanium and vanadium have no beneficial effects on either strength or corrosion resistance and both elements are known to be detrimental to high temperature flow stress and therefore extrudability. However, titanium is used as a grain refiner during casting, either on its own or when added in conjunction with boron to form $TiB_2$, when added in a concentration up to 0.05 wt %. In an embodiment, the titanium content of the aluminum alloy is below 0.05 wt %, in another embodiment, it is below 0.03 wt %, and, in still another embodiment, it is ranges between 0.005 and 0.025 wt %. In an embodiment, the vanadium content of the aluminum alloy is below 0.05 wt %, in another embodiment, it is below 0.03 wt % and, in still another embodiment, it is below 0.02 wt %.

It is appreciated that the alloying element content for a particular alloying element can be selected from any of the above-described embodiments and it can differ from the embodiment of another alloying element. For example and without being limitative, in an embodiment of the aluminum alloy, the aluminum alloy can have a manganese content ranging between 0.60 and 0.90 wt % and a magnesium content ranging between 0.05 and 0.12 wt %.

Experiment 1

A series of six (6) experimental alloys were direct-chill (DC) cast as 101 millimeter (mm) diameter billet. The compositions are shown in Table 1. Alloy AA 3003 was included as a reference material as it is currently used as extruded tubing in heat exchangers such as charge air coolers. All the alloys were cut into billets and homogenized for four (4) hours at 600° C. The homogenization step was followed by a controlled cooling at a cooling rate of 150° C. per hour to decrease the alloy flow stress and make it more extrudable or drawable. Alloys A to D and reference alloy 3003 were extruded consecutively, starting with four (4) billets of 3003 followed by two (2) billets of each experimental composition. The billets were preheated to 500° C. and extruded at a ram speed of 15 mm per second (sec.) into a strip profile 3 mm×41.7 mm. The strip was quenched using fans to give a quench rate of 8° C. per sec. Extrusion pressure was monitored during the test and peak extrusion pressures were recorded for the second billet of each alloy to avoid any carry over effects from the previous variant.

Extrusion pressure is a commonly used measure of ease of extrusion. An alloy with lower extrusion pressure is said to be more extrudable and this reflects the ability to extrude the alloy at higher speed and lower cost or into more complex shapes.

Alloys E and F were extruded separately and extrusion pressures were not recorded.

Sections of the strip were given a simulated braze cycle heating at 15° C. per minute (min) to 600° C., holding for two (2) minutes then still air cooling to room temperature.

Tensile samples were machined and then tested at 290° C. (according to ASTM E21) after holding for five (5) minutes at the test temperature. A second set of samples were exposed for 1000 hours at 290° C. and then tensile tested at 290° C. to investigate the effects of long term thermal exposure.

Referring now to Table 1, reproduced below, aluminum alloy compositions are shown that were manufactured and tested in the first experiment. Their measured extrudability and mechanical properties are given in Table 2, also reproduced below.

The AA 3003 base alloy is a typical aluminum composition used for extruded tubing in a range of heat transfer applications and was used as a reference aluminum alloy in all experiments.

Aluminum alloy 1 was of similar composition to materials used commercially for brazing sheet which can be fabricated into tubing by folding and resistance welding. This alloy, designed for sheet products, has a high manganese content and is difficult to extrude into hollow relatively thin walled tubing and was also included for comparative purposes.

Aluminum alloys 5 and 6 included additions of Ti and V respectively comparatively to reference alloy AA 3003. Such additions have been used in extruded heat exchanger tubing alloys for various reasons and might have been expected to give some improvement in high temperature strength through solid solution strengthening.

The remaining aluminum alloys compositions, i.e. aluminum alloys 2 to 4, contained varying levels of magnesium, copper and manganese. In comparison to aluminum alloy 1, aluminum alloy 2 had a lower manganese content while aluminum alloy 3 had a manganese content similar to aluminum alloy 2 but a lower copper content. Finally, aluminum alloy 4 had a copper content similar to aluminum alloys 1 and 2, a manganese content similar to aluminum alloys 2 and 3 but a lower magnesium content than aluminum alloys 1 to 3.

TABLE 1

Aluminum alloy Compositions.

| | in weight % (wt %) | | | | | | | |
|---|---|---|---|---|---|---|---|---|
| Alloy | Cu | Mg | Mn | Fe | Si | Ti | V | Cu/Mg |
| 1 | 0.62 | 0.24 | 1.50 | 0.20 | 0.10 | 0.02 | <0.01 | 2.6 |
| 2 | 0.61 | 0.24 | 0.76 | 0.20 | 0.10 | 0.02 | <0.01 | 2.5 |
| 3 | 0.29 | 0.24 | 0.75 | 0.18 | 0.09 | 0.02 | <0.01 | 1.2 |
| 4 | 0.61 | 0.14 | 0.74 | 0.19 | 0.10 | 0.02 | <0.01 | 4.4 |
| AA 3003 | 0.08 | <0.01 | 1.06 | 0.57 | 0.22 | 0.02 | <0.01 | — |
| 5 | 0.07 | <0.01 | 1.01 | 0.17 | 0.21 | 0.17 | <0.01 | — |
| 6 | 0.08 | <0.01 | 1.01 | 0.19 | 0.09 | 0.02 | 0.20 | — |

TABLE 2

Extrudability and Mechanical Properties.
All Strengths measured at 290° C. in MPa.

| Alloy | BTP (psi) | ΔP (%) | UTS | PS | UTS (1000 hr) | PS (1000 hr) |
|---|---|---|---|---|---|---|
| 1 | 2200 | 37 | 66.8 | 50.6 | 58.9 | 41.1 |
| 2 | 1980 | 23 | 61.6 | 41.8 | 55.1 | 36.1 |
| 3 | 1900 | 18 | 56.4 | 37.1 | 52.2 | 33.4 |
| 4 | 1750 | 9 | 56.0 | 38.6 | 51.5 | 34.0 |
| AA 3003 | 1610 | 0 | 43.7 | 32.0 | 37.0 | 23.6 |
| 5 | — | — | 42.8 | 29.9 | | |
| 6 | — | — | 37.5 | 27.1 | | |

Table 2 summarizes extrusion results and tensile properties for all aluminum alloys presented in Table 1. It includes extrusion breakthrough pressure (BTP) in psi, relative BTP increase versus reference aluminum alloy AA 3003 (ΔP) as a measure of extrudability $$\Delta P = \frac{BTP_{alloy} - BTP_{3003}}{BTP_{3003}} \times 100,$$

tensile strength (UTS) and proof strength (PS) tested at 290° C. for instantaneous testing and after 1000 hour exposure. Low ΔPs are associated with relatively easily extrudable alloys. Finally, FIG. 1 shows UTS and PS for instantaneous testing and after 1000 hour exposure as well as BTP versus the aluminum alloy composition.

From FIG. 1, it was observed that the 1000 hour UTS and PS properties show the same trends as the instantaneous UTS and PS properties except there is a loss of strength in every case.

Aluminum alloys 5 and 6, which include additions of Ti and V respectively, did not give any significant benefit over reference alloy AA 3003 while alloys 1 to 4 exhibited some improvement in strength at 290° C. comparatively to reference alloy AA 3003. Moreover, alloys 1 to 4 had higher BTP than reference alloy AA 3003 with alloy 4 having the second lowest BTP.

Table 3, reproduced below, shows values of strength improvement/extrusion pressure increase or "strength/extrudability efficiency" versus reference alloy AA 3003, i.e. (Strength(alloy)−Strength (AA 3003))/ΔP(alloy). The units are MPa per percentage of extrusion pressure increase (MPa/%). Surprisingly, aluminum alloy 4 consistently gave the highest ranking for all strength measurements. In some cases, the strength/extrudability efficiency ratio doubled that of the next best performing aluminum alloy, i.e. alloy 3.

TABLE 3

Strength Improvement over 3003/ΔP rankings.

| | Strength/Extrudability Efficiency | | | |
|---|---|---|---|---|
| Alloy | UTS/ext | PS/ext | UTS/ext (1000 hr) | PS/ext (1000 hr) |
| 1 | 0.63 | 0.51 | 0.60 | 0.48 |
| 2 | 0.78 | 0.43 | 0.79 | 0.54 |
| 3 | 0.71 | 0.28 | 0.84 | 0.54 |
| 4 | 1.41 | 0.76 | 1.67 | 1.20 |

Table 4, reproduced below, shows the percentage of strength loss with long term exposure at 290° C. i.e.

$$\frac{Strength_{inst} - Strength_{1000hr}}{Strength_{inst}} \times 100.$$

Aluminum alloys 3 and 4 exhibited a reduced loss of strength compared to the stronger aluminum alloys 1 and 2 and also as compared with reference alloy AA 3003.

TABLE 4

Percentage of Strength Loss During 1000 Hour Exposure at 290° C.

| Alloy | UTS (% drop) | PS (% drop) |
|---|---|---|
| 1 | 12 | 19 |
| 2 | 11 | 14 |
| 3 | 7 | 10 |
| 4 | 8 | 12 |
| AA 3003 | 15 | 26 |

Overall, aluminum alloy 4 gave the best balance of extrudability and strength improvement over reference alloy AA 3003 with minimal influence of exposure time at elevated temperature.

The effects of the various elements in these tests can be interpreted as follows.

Aluminum alloy 1, which has the highest manganese content, is similar to a brazing sheet alloy, which has high strength but has poor extrudability and cannot be extruded into thin wall (<1.5 mm) tubing, such as and without being limitative heat exchanger tubes. Reducing the manganese level from 1.5 wt % to about 0.75 wt %, as in the case of aluminum alloy 2, gave some loss of strength but extrudability, measured by ΔP, improved along with the strength/extrudability factor (see Table 3). Also the loss of strength with increasing exposure time on strength at 290° C. was reduced (see Table 4).

Reducing the magnesium content from 0.25 wt % to 0.15 wt % (alloy 2 versus alloy 4) resulted in some loss of strength but this is compensated by the improvement in strength/extrudability factor (see Table 3) and a further reduction in the effect of increased exposure time at 290° C. (see Table 4).

Reducing the copper content from 0.61 wt % in aluminum alloy 2 to 0.29 wt % in aluminum alloy 3, while maintaining the magnesium content at 0.25, gave a loss of strength with only moderate improvement in extrudability. The combination of lower Mg and higher Cu contents in alloy 4 gave about the same strength levels as alloy 3 but with markedly reduced extrusion pressure giving a significant improvement in strength/extrudability factor.

Figure 2:
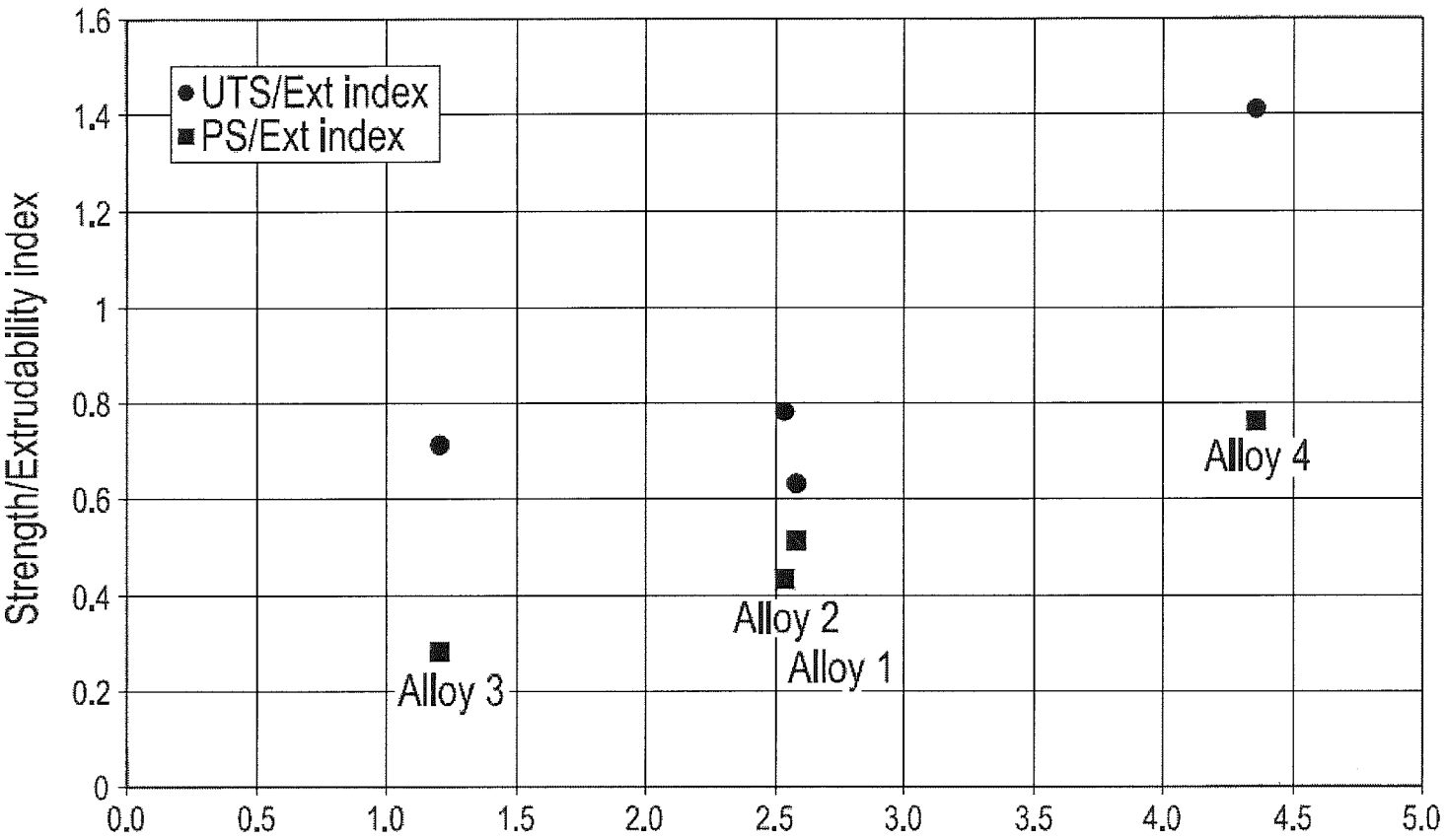
FIG. 2 is a graph showing the strength/extrudability index versus the Cu/Mg ratio for the aluminum alloys 1 to 4 presented in Table 1.

If the Cu/Mg ratio of the different alloys is considered, as shown in FIG. 2, the strength/extrudability index, either for proof strength or tensile strength improves in a near linear fashion with increasing Cu/Mg ratio. A Cu/Mg ratio higher or equal to 3 gives improved performance.

Neither of the elements titanium and vanadium added at the 0.17 and 0.20 wt % level in aluminum alloys 5 and 6 respectively gave any improvement in mechanical properties. Both elements should be maintained lower or equal to 0.05 wt % as they are known to be detrimental to high temperature flow stress.

Titanium is added as a grain refiner during casting, either on its own or in conjunction with boron, to produce a fine cast grain structure and prevent formation of feather grains which can produce non uniform deformation during extrusion.

Experiment 2

A further series of aluminum alloys, including some of those from experiment 1, were tested using a corrosion test designed to assess resistance to attack by diesel engine condensate. Recirculation of diesel engine exhaust back through the turbocharger, the charge air cooler, and the engine is becoming increasingly common to meet emission legislation. As the air mixed with exhaust gas is cooled, condensation occurs within the heat exchanger. Resistance to corrosion by this condensate containing nitric and sulphuric acids is an important property for tubing materials. Examples of typical condensate compositions are available in the literature for example in SAE #05P-660-2004—Assessment of Corrosivity Associated with Exhaust Gas Recirculation in a Heavy Duty Diesel Engine—Kass et al.

The new alloys were cast as 101 mm diameter ingots and homogenized at temperatures ranging between 580 and 620° C. The homogenization step was followed by a controlled cooling at a cooling rate of 100° C. per hour. Aluminum alloys 1 to 4 were the same alloys included in experiment 1. They were extruded under the same conditions and given the same braze cycle simulation as described in experiment 1.

Aluminum alloy 7 had similar copper, manganese, iron, silicon, titanium, and nickel contents to alloys 2 to 4 but also had a lower magnesium content. Aluminum alloy 8 had similar copper, magnesium, iron, silicon, titanium, and nickel contents to alloy 7 but had a higher manganese content. Aluminum alloy 9 had similar magnesium, manganese, iron, silicon, titanium, and nickel contents to alloy 4 but had a lower copper content. Aluminum alloy 10 had similar copper, magnesium, manganese, silicon, and titanium contents to alloy 7 but had higher iron and nickel contents. Finally, aluminum alloy 11 had similar copper, magnesium, manganese, silicon, and titanium contents to alloy 7 but had a lower iron content and a higher titanium content.

Samples with approximate dimensions 50 mm×7 mm×3 mm were cut from the extruded lengths, given a braze simulation and degreased in ethyl alcohol. These were immersed in a solution of distilled water acidified with 2 milliliter (ml) per liter nitric and 102 ml per liter sulphuric acids held with a pH of 0.3 at 80° C. The composition of the test solution was derived from published data on diesel engine condensates. The time of exposure was seven (7) days. At the end of the test the samples were rinsed and any corrosion deposits brushed off. The maximum depth of corrosion attack was measured with an optical microscope using the procedure described in ASTM G46. Tensile properties were also measured at 290° C. after 1 hour exposure according to ASTM E21.

Alloys 4, 8 and AA 3003 were extruded separately in order to compare extrusion pressures. The breakthrough pressure increase over AA 3003 was calculated along with the strength/extrudability efficiency as described in experiment 1. The results are presented in Table 5, reproduced below.

TABLE 5

Experiment 2 - Alloy Compositions and Results.

| Alloy | Cu (wt %) | Mg (wt %) | Mn (wt %) | Fe (wt %) | Si (wt %) | Ti (wt %) | Ni (wt %) | Cu/Mg | UTS | Depth (mm) | ΔP (%) | UTSeff (MPa/%) |
|---|---|---|---|---|---|---|---|---|---|---|---|---|
| 1 | 0.62 | 0.24 | 1.50 | 0.20 | 0.10 | 0.02 | <0.01 | 2.6 | 58.1 | 0.08 | | |
| 2 | 0.61 | 0.24 | 0.76 | 0.20 | 0.10 | 0.02 | <0.01 | 2.5 | 45.8 | 0.08 | | |
| 3 | 0.29 | 0.24 | 0.75 | 0.18 | 0.09 | 0.02 | <0.01 | 1.2 | 51.0 | 0.07 | | |
| 4 | 0.60 | 0.15 | 0.75 | 0.20 | 0.10 | 0.02 | <0.01 | 4.0 | 47.7 | 0.07 | 9 | 0.9 |
| 7 | 0.59 | <0.01 | 0.75 | 0.19 | 0.09 | 0.02 | <0.01 | — | 40.4 | 0.09 | | |
| 8 | 0.59 | <0.01 | 1.19 | 0.20 | 0.09 | 0.02 | <0.01 | — | 49.0 | 0.08 | 28 | 0.4 |
| 9 | 0.02 | 0.16 | 0.78 | 0.19 | 0.09 | 0.02 | <0.01 | 0.1 | 40.0 | 0.09 | | |
| 10 | 0.60 | <0.01 | 0.71 | 0.58 | 0.10 | 0.02 | 0.48 | — | 41.1 | 0.10 | | |
| 11 | 0.62 | <0.01 | 0.81 | 0.10 | 0.10 | 0.15 | <0.01 | — | 39.1 | 0.08 | | |
| AA 3003 | 0.08 | <0.01 | 1.06 | 0.22 | 0.22 | 0.02 | <0.01 | — | 39.2 | 0.08 | | |

Results with significant improvements over reference alloy AA 3003 in terms of corrosion depth or tensile strength (UTS) are in italic in the appropriate columns Table 5.

In terms of the corrosion results, aluminum alloys 3 and 4 experienced the shallowest attack of the alloys tested and were the only alloys to undergo less attack than reference alloy AA 3003. In contrast, aluminum alloys 1 and 2 with a higher combined copper and magnesium content exhibited more attack.

Figure 3A:
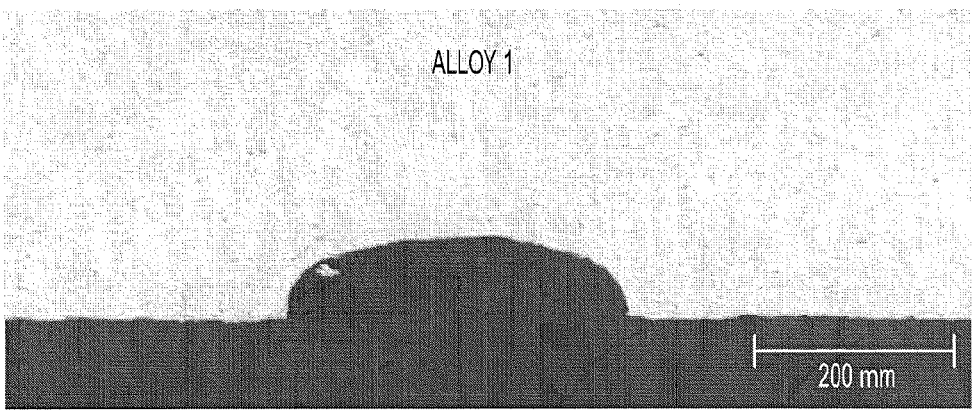
FIG. 3 includes FIG. 3*a* and FIG. 3*b* and are micrographs of cross sections of alloys 1 and 4 respectively after corrosion attack.
Figure 3B:
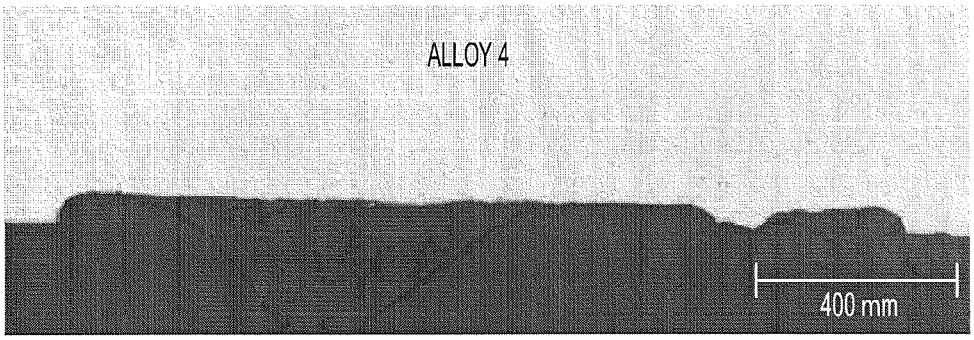

FIG. 3 shows metallographic cross sections through the corrosion sites on aluminum alloys 1 and 4. Alloy 1 tended to give deeper more localized attack whereas alloy 4 gave broader shallower pits which is usually preferable.

There was no significant effect of decreasing the manganese content from alloy 1 to alloy 2, which had approximately 50% less Mn than alloy 1. This result is somewhat surprising as manganese additions are generally thought to improve corrosion resistance.

Alloy 10 with an addition of nickel and iron gave the most severe attack of all the samples. Alloy 11 with a titanium addition still exhibited inferior corrosion resistance to alloy 4. Alloy 9 also gave inferior corrosion performance compared to alloy 4 indicating that the copper addition to alloy 4 is beneficial in this respect. Alloy 7 suffered more attack than alloy 4 indicating the magnesium present in alloy 4 is also beneficial. Alloy 8 is a higher manganese containing alloy without a magnesium addition but the results were still inferior to alloy 4.

In terms of high temperature tensile strength, the alloys that gave more than a 10% improvement over AA 3003 are in italic in the UTS column in Table 5. These include alloys 1-4, but experiment 1 has already indicated that while alloys 1-3 can achieve attractive strength levels this is at the expense of extrudability. Alloy 8, containing 1.19 wt % manganese and without a magnesium addition, also gave a useful strength increase, which is similar to the Alloy 4 strength increase. However, although alloy 8 did not contain magnesium, which is well known to be detrimental to high temperature flow stress, in a direct comparison it gave an increase in extrusion pressure of 28% versus 9% for alloy 4 with a resulting low value of strengthening efficiency, which can be attributed to the increased manganese content.

Overall, the results indicate that a combined but limited copper and magnesium addition, such as is the case with alloys 3 and 4, promotes resistance to the simulated condensate attack.

Additions of iron, titanium, and nickel are detrimental to condensate corrosion resistance and there is no benefit from increased manganese levels. Moreover, increased manganese contents are detrimental to extrudability.

Although alloys 3 and 4 gave similar corrosion resistance, the significant benefit in strengthening efficiency of alloy 4 make its composition more advantageous for extruded tube applications.

Experiment 3

A further series of alloys were cast and homogenized as described in experiment 1. As for the previous experiment, the homogenization step was followed by a controlled cooling at a cooling rate of 100° C. per hour. The compositions were designed such that they were similar to alloy 4 but with varying levels of copper addition. As for the previous experiments, reference alloy AA 3003 was included as a control and aluminum alloy 9 was the same alloy included in experiment 2.

The billets were extruded into a 1.3 mm "I-beam" profile with an extrusion ratio of 120:1. The billets were preheated to 500° C. and extruded at a ram speed of 10 mm per sec. Three billets of each alloy were extruded in sequence to obtain accurate ram pressure data in order to assess extrudability. Coupons were again given a simulated brazing cycle and corrosion resistance and tensile strength at 290° C. were measured as described in experiment 2. The pressure increase versus the reference alloy AA 3003 and resulting strengthening efficiency were calculated. Table 6 summarizes the alloy compositions and test results, ranked in terms of increasing copper content. Corrosion and UTS results superior to reference alloy AA 3003 are in italic in the appropriate columns. Some of the results in Table 6 are plotted in FIG. 4, and will be described in more details below.

TABLE 6

Experiment 3 - Alloy Compositions and Results.

| Alloy | Cu (wt %) | Fe (wt %) | Mg (wt %) | Mn (wt %) | Ni (wt %) | Si (wt %) | Ti (wt %) | Cu/Mg | UTS (MPa) | Depth (mm) | M pt (C) | ΔP (%) | UTSeff (MPa/%) |
|---|---|---|---|---|---|---|---|---|---|---|---|---|---|
| 9 | 0.02 | 0.19 | 0.16 | 0.78 | 0.001 | 0.09 | 0.02 | 0.1 | 40.1 | 0.13 | 643 | 4.3 | 0.2 |
| 12 | 0.38 | 0.18 | 0.16 | 0.76 | 0.0015 | 0.09 | 0.0170 | 2.4 | 46.3 | 0.12 | 636 | 15.5 | 0.5 |
| 4 | 0.60 | 0.20 | 0.15 | 0.75 | 0.001 | 0.10 | 0.02 | 4.0 | 48.6 | 0.07 | 632 | 20.5 | 0.5 |
| 13 | 0.79 | 0.19 | 0.15 | 0.77 | 0.001 | 0.09 | 0.021 | 5.3 | 51.4 | 0.08 | 629 | 21.2 | 0.6 |
| 14 | 1.01 | 0.20 | 0.15 | 0.77 | 0.0013 | 0.09 | 0.017 | 6.7 | 55.6 | 0.08 | 625 | 24.3 | 0.7 |
| AA 3003 | 0.08 | 0.22 | <0.01 | 1.06 | <0.01 | 0.22 | 0.02 | — | 39.2 | 0.08 | 645 | | |

Figure 4:
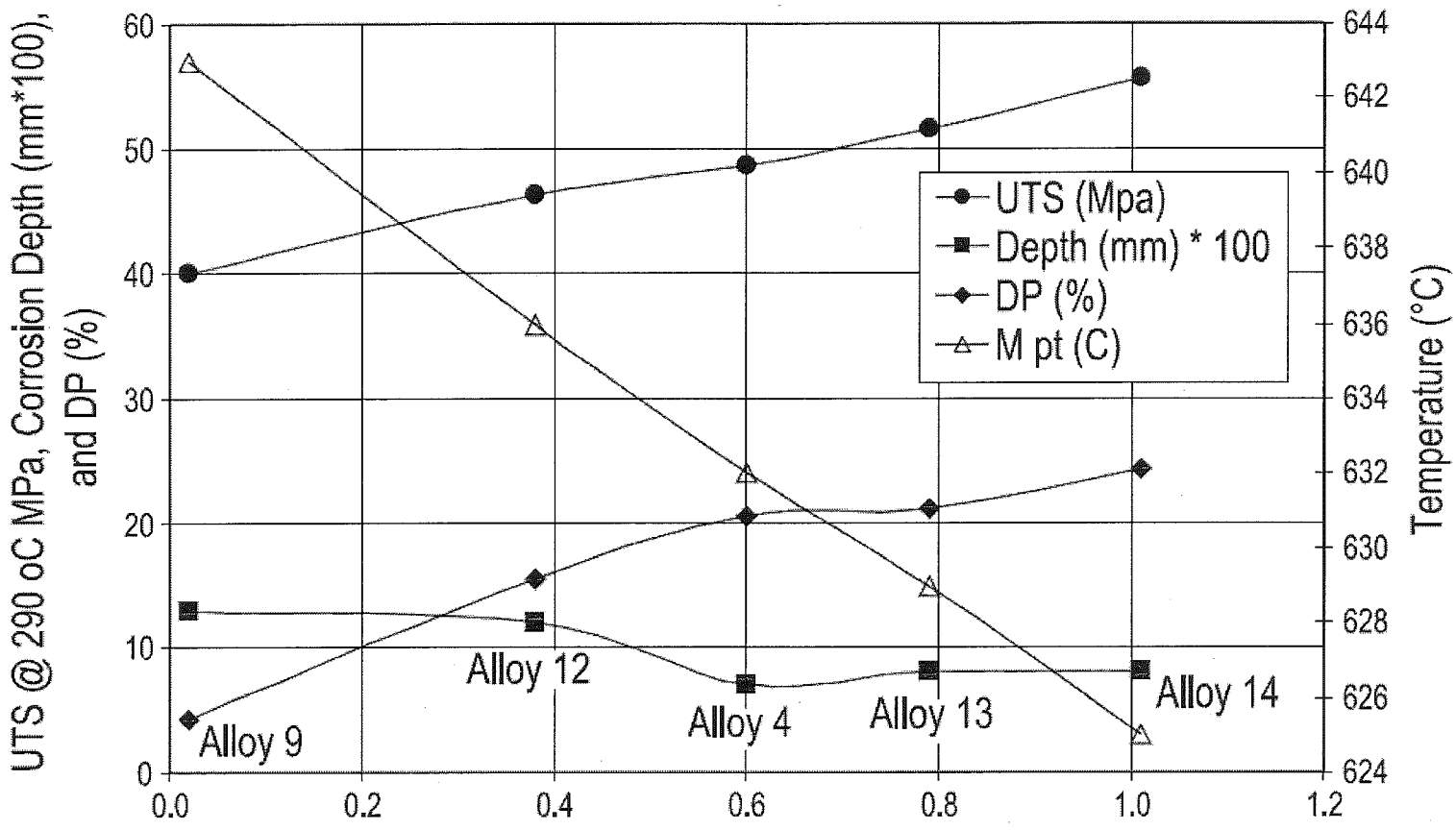
FIG. 4 is a graph showing the effect of copper addition on UTS at 290° C., corrosion depth, extrudability (ΔP) and alloy melting point.

In terms of corrosion attack, only alloy 4 with 0.60 wt % copper experienced less attack than reference alloy AA 3003. Alloys 9 and 12 with a copper content less than 0.40 wt % exhibited significantly more attack again indicating that the presence of copper at the levels present in alloy 4 is beneficial. As shown in FIG. 4, the corrosion attack was relatively level above this point.

Tensile strength and extrusion pressure both increased fairly linearly with increasing copper. Strengthening efficiencies (UTSeff) were similar for alloys 4 and 12-14.

However, one detrimental feature of increasing copper levels is the depression of the alloy melting point. This has some impact on extrudability as it limits the maximum temperature and resulting extrusion speed at which the product can leave the extrusion die. Also for commercial brazing applications, where braze temperatures can range from 600-620° C., it is undesirable to melt the tube alloy so a minimum solidus temperature of 630° C. is usually desired which translates to a maximum copper content of approximately 0.80 wt %.

Based on the experiments conducted, aluminum alloy 4 gave the best combination of extrudability, elevated temperature strength, condensate corrosion resistance and brazeability.

The aluminum alloy can be homogenized as a billet, prior to the extrusion and drawing steps. The homogenization step can be carried out at a temperature above 570° C. and below the aluminum alloy melting point for up to 8 hours. In an embodiment, the homogenization step is carried out at a temperature below approximately 620° C. Then, the alloy can be cooled at a cooling rate below 200° C. per hour. The homogenization step followed by a controlled cooling decreases the alloy flow stress and makes it more extrudable or drawable. The lower limit for the homogenization temperature is determined by the temperature at which the extrusion pressure starts to rise due to formation of fine dispersoids.

More particularly, the homogenization cycle, including heating, soaking, and cooling steps, is selected to obtain a conductivity of 35 to 38% IACS (International Annealed Copper Standard). The cast aluminum alloy material typically has a conductivity of 32 to 33% IACS. Thus, the homogenization cycle increases the aluminum alloy conductivity.

Conductivity is used to assess the level of manganese in solid solution. Manganese in solid solution directly contributes to higher extrusion pressure. An increase of 2 to 6 IACS units represents the precipitation of 0.11 to 0.29 wt % of manganese from solid solution as manganese rich dispersoids during the homogenization cycle or 15 to 38 wt % of the total manganese content of the aluminum alloy. Taking manganese out of solid solution and precipitating as dispersoids during the homogenization cycle reduces flow stress and consequently extrusion pressure.

In the homogenization cycle, the heating and soaking steps contribute to the precipitation of manganese from solid solution as manganese rich dispersoids, i.e. relatively coarse particles, that are unaffected by the extrusion cycle.

The homogenization temperature should be controlled to ensure that a controlled manganese precipitation occurs. Higher manganese precipitation and conductivity, i.e. above 38% IACS, result from low homogenization temperatures, for instance below 540° C. However, the dispersoid distribution is relatively too fine and it contributes to higher flow stress and extrusion pressure. In contrast, high homogenization temperatures result in excessive manganese dissolution, low conductivity, and high flow stress. As a result, the optimum homogenization condition is an intermediate temperature which can be defined by upper and lower conductivity limits.

The billet/ingot is further heated prior to the extrusion cycle. The homogenized billet/ingot is heated to approximately 450-520° C., below the homogenization temperature, during approximately 30 minutes. The objective is to retain the homogenized structure which leads to reduced extrusion pressure and increased productivity during the following extrusion cycle.

Figure 5B:
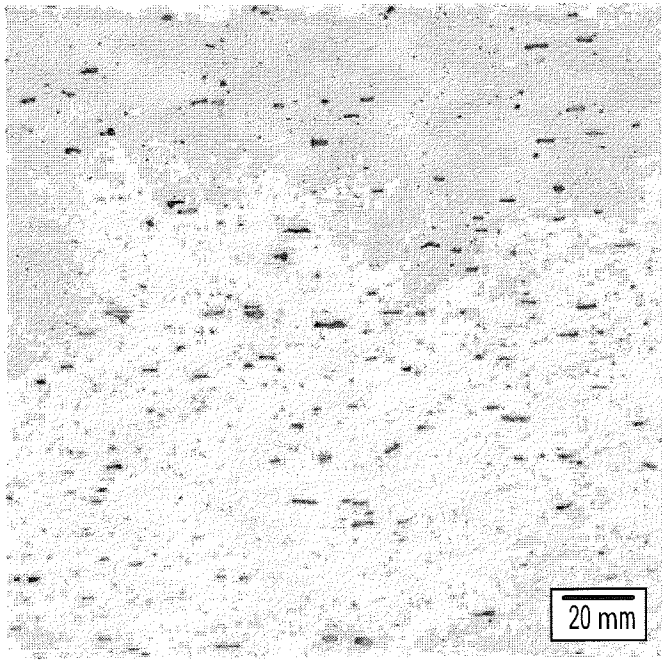
FIG. 5 includes FIG. 5*a* and FIG. 5*b* which are micrographs showing the dispersoid distribution after the extrusion and the brazing cycles respectively.
Figure 5A:
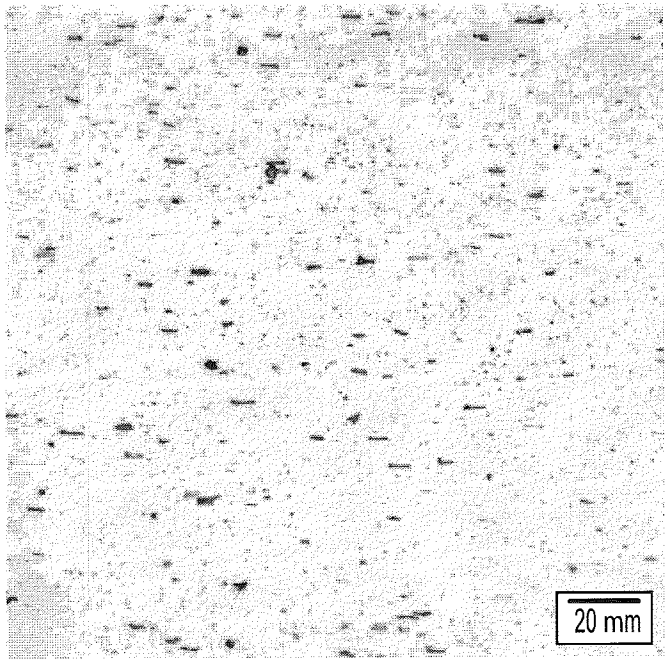

In the brazing cycle that follows the extrusion cycle, dissolution of the dispersoids is not a required feature. More particularly, FIG. 5 shows that the dispersoids are in evidence after the extrusion and the brazing cycles.

Table 7, reproduced below, shows the conductivity from cast through homogenization, extrusion and braze cycles for alloy 4 processed as in experiment 1.

TABLE 7

Conductivity from cast through homogenization, extrusion and braze cycles.

| Condition | IACS (%) |
|---|---|
| Cast | 32.6 |
| Homogenized | 36.5 |
| Extruded | 36.6 |
| Extruded and brazed | 36.1 |

There is no conductivity change between the homogenized ingot and the extrusion, and only a small conductivity drop during the brazing cycle. This drop of 0.5% IACS corresponds to the dissolution of approximately 0.02 wt % of manganese during the brazing cycle, i.e. only a small fraction of the precipitated manganese during homogenization dissolves during the following brazing cycle.

The effects of each element can be summarized as follows in the following paragraphs.

As mentioned above, at high levels, manganese is detrimental to extrudability and although some elevated strengthening can be achieved, it has a poor strengthening efficiency. Manganese content should be lower than 1.20 wt % in an embodiment.

Less than 0.25 wt % magnesium is beneficial to extrudability and strength efficiency but a deliberate addition is necessary for acceptable corrosion resistance.

A copper addition of approximately 0.60 wt % combined with a magnesium addition of less than 0.25 wt % gives a good combination of strength and strength efficiency. A Cu/Mg ratio higher or equal to 3.0 is beneficial in this respect. In an embodiment, the Cu/Mg ratio is below 15. Strength and extrusion pressure increase linearly with copper content but the strength efficiency remains relatively stable. A minimum addition of 0.40 wt % copper is necessary for good corrosion resistance but above 0.80 wt % copper, the alloy solidus becomes too low for successful furnace brazing.

High iron levels of approximately 0.60 wt % were shown to be detrimental to corrosion resistance. There were no measurable effects on extrudability or strength but lower levels are known to be beneficial for the quality of the extruded surface finish. In an embodiment, an upper limit of 0.30 wt % is applicable.

In an embodiment, the silicon content is maintained below 0.30 wt % to make the material compatible with sacrificial "brown band" formation due to silicon diffusion from the filler metal during brazing.

An addition of 0.48 wt % nickel gave the highest level of corrosion attack in the tests conducted. The element has no benefits on high temperature strength and, in an embodiment, it should be kept below 0.05 wt %.

Deliberate addition of 0.15 wt % titanium and 0.20 wt % vanadium had no beneficial effects and both elements are known to be detrimental to high temperature flow stress and therefore extrudability. In an embodiment, titanium and vanadium contents should be below 0.05 wt % and titanium can be added as a grain refiner during casting within this range.

Thus, in an embodiment, the aluminum alloy includes between 0.60 and 0.90 wt % manganese, between 0.05 and 0.24 wt % magnesium, between 0.45 and 0.75 wt % copper, below 0.30 wt % iron, below 0.30 wt % silicon, below 0.05 wt % titanium, and below 0.05 wt % vanadium. The Cu/Mg ratio is above or equal to 3. Moreover, the aluminum alloy includes less than 0.05 wt % nickel. The remainder is aluminum and inevitable impurities.

It is appreciated that, in alternative embodiments, the range for one or several alloying elements can vary from the one described above. For example and without being limitative, the aluminum alloy can include between 0.65 and 0.85 wt % or between 0.70 and 0.80 wt % Mn, between 0.05 and 0.20 wt % or between 0.05 and 0.12 wt % Mg, between 0.50 and 0.60 wt % or between 0.57 and 0.63 wt % Cu, below 0.25 wt % or between 0.15 and 0.25 wt % Fe, below 0.20 wt % or between 0.05 and 0.15 wt % Si, below 0.03 wt % or between 0.005 and 0.025 wt % Ti, and below 0.03 wt % or below 0.02 wt % vanadium.

The cast billet or ingot can be homogenized at a temperature above 570° C. and below the aluminum alloy melting point for up to 8 hours. The homogenization cycle can include a controlled cooling step carried out at a cooling rate below 200° C. per hour to decrease the alloy flow stress, which makes it more extrudable or drawable. The parameters of the homogenization cycle are selected to obtain a conductivity of 35 to 38% IACS, which is higher than the conductivity of the cast aluminum alloy material.

The aluminum alloy described above can be used as a billet for the production of heat exchanger extrusions. For example and without being limitative, the end product can be thin wall <1.5 mm extruded or drawn tube assembled into a brazed heat exchanger. The brazing step can be, for instance a vacuum brazing or controlled atmosphere brazing (CAB) wherein at least one tubing section is brazed to heat exchanger components such as manifold, internal and external corrugated fins, etc. These heat exchangers can be used in charge air coolers, for instance.

It is appreciated that the aluminum alloy can be used for any extruded application where corrosion resistance, elevated temperature strength and extrudability are required. It also includes non brazed applications and any other applications where good elevated properties are desirable.

The embodiments of the invention described above are intended to be exemplary only. The scope of the invention is therefore intended to be limited solely by the scope of the appended claims.

The invention claimed is:

1. An extruded or drawn tube for an aluminum alloy heat exchanger comprising an aluminum alloy composition consisting of, in weight percent, between 0.60 and 0.90 manganese, between 0.45 and 0.75 copper, between 0.05and 0.24 magnesium, less than 0.30 iron, less than 0.30 silicon, less than 0.05 titanium, less than 0.05 vanadium, other elements up to 0.05 each and up to 0.15 in total, and a Cu/Mg ratio higher or equal to 3; wherein the tube has a thickness of less than 1.5 mm; wherein the alloy when extruded into a tube has a breakthrough pressure of <18% higher than an AA3003 alloy extruded into an identical profile at the same billet temperature and ram speed.

2. An extruded or drawn tube as claimed in claim 1, wherein the tubes are extruded from a billet.

3. An extruded or drawn tube as claimed in claim 1, wherein the Cu/Mg ratio is below 15.

4. An extruded or drawn tube as claimed in claim 1, wherein the aluminum alloy composition has a tensile strength higher or equal to 48 MPa, tested at 290° C. for instantaneous testing.

5. An extruded or drawn tube as claimed in claim 1, wherein the aluminum alloy composition has a proof strength higher or equal to 35 MPa, tested at 290° C. for instantaneous testing.

6. An extruded or drawn tube as claimed in claim 1, wherein the tubes are extruded from a homogenized billet.

7. An extruded or drawn tube as claimed in claim 6, wherein the billet is homogenized at a temperature ranging between 570 ° C. and the melting temperature of the aluminum alloy composition for up to eight hours.

8. An extruded or drawn tube as claimed in claim 7, wherein the homogenization step is followed by a controlled cooling step carried out at a cooling rate below 200 ° C. per hour.

9. An extruded or drawn tube as claimed in claim 1, wherein the billet is subjected to a homogenization step and has a conductivity ranging between 35 and 38% IACS following the homogenization step.

10. An extruded or drawn tube as claimed in claim 8, wherein the billet following the cooling step has a conductivity ranging between 35 and 38% IACS.

11. An extruded or drawn tube as claimed in claim 1, wherein the billet is subjected to a homogenization step and the tubes have a conductivity ranging between 35 and 38% IACS.

12. An extruded or drawn tube as claimed in claim 1, wherein the tubes are brazeable to at least one heat exchanger component.

13. An extruded or drawn tube as claimed in claim 1, wherein the tubes are designed for charge air coolers.

14. An extruded or drawn aluminum alloy tubing comprising an aluminum alloy composition consisting of, in weight percent, between 0.60 and 0.90manganese, between 0.45 and 0.75 copper, between 0.05 and 0.24 magnesium, less than 0.30 iron, less than 0.30 silicon, less than 0.05 titanium, less than 0.05vanadium, other elements up to 0.05 each and up to 0.15 in total, and a Cu/Mg ratio higher or equal to 3; wherein the tubing has a wall thinner than 1.5 mm, wherein the alloy when extruded into a tube has a breakthrough pressure of <18% higher than an AA3003 alloy extruded into an identical profile at the same billet temperature and ram speed.

15. An extruded or drawn aluminum alloy tubing as claimed in claim 14, wherein the tubing is extruded from a billet.

16. An extruded or drawn aluminum alloy tubing as claimed in claim 15, wherein the billet is subjected to a homogenization step carried out at a temperature ranging between 570 ° C. and the melting temperature of the alloy for up to eight hours and the homogenization step is followed by a controlled cooling step carried out at a cooling rate below 200 ° C. per hour.

17. An extruded or drawn aluminum alloy tubing as claimed in claim 16, wherein the aluminum alloy has a conductivity ranging between 35 and 38% IACS following the cooling step.

* * * * *